United States Patent [19]

Switzer

[11] 4,261,570

[45] Apr. 14, 1981

[54] FIELD SURFACE RELATED PROJECTILE TARGET CONSTRUCTION

[76] Inventor: William K. Switzer, 5703 Sprucewood Dr., Cincinnati, Ohio 45239

[21] Appl. No.: 72,885

[22] Filed: Sep. 6, 1979

[51] Int. Cl.[3] ..... A63B 71/00

[52] U.S. Cl. ..... 273/127 B; 273/118 D

[58] Field of Search ..... 273/127 R, 127 B, 85 R, 273/85 A, 86 D, 86 E, 87 G, 87 H, 56, 118 D, 411, 176 B, 176 AA, 177 R, 177 A, 181 R, 178 R, 184 R, 184 A, 179 R, 35, 348, 372, 375, 374, 378, 381, 386, 390, 391, 392

[56] References Cited

U.S. PATENT DOCUMENTS

| | | | |
|---|---|---|---|
| 1,136,708 | 4/1915 | Osburn | 273/177 A |
| 1,656,740 | 1/1928 | Kurtz | 273/127 B |
| 3,313,544 | 4/1967 | Davis | 273/177 A |
| 3,458,202 | 7/1969 | McNamara | 273/177 R |
| 3,858,888 | 1/1975 | Young | 273/177 R |
| 3,909,007 | 9/1975 | Wuertemberg et al. | 273/177 A |

FOREIGN PATENT DOCUMENTS

| | | | |
|---|---|---|---|
| 184409 | 8/1922 | United Kingdom | 273/177 A |
| 504628 | 4/1939 | United Kingdom | 273/177 R |

*Primary Examiner*—Richard C. Pinkham
*Assistant Examiner*—T. Brown
*Attorney, Agent, or Firm*—Walter S. Murray

[57] ABSTRACT

An outdoor game target construction to be hand pressed or impact-driven into a ground area forming the field surface, a series of targets being disposed in spaced apart locations on said surface and each when aimed at and successfully struck by a game ball rolling on said surface will emit a distinctive sound indicative of the fact that it had been hit. The invention also includes an improved and simplified means for mechanically mounting a sound producing cylinder to a ground stake whereby the cylinder will have universal swinging movement upon the stake insuring that the target will emit a sound when struck by a ball aimed at it from any angle.

2 Claims, 6 Drawing Figures

FIELD SURFACE RELATED PROJECTILE TARGET CONSTRUCTION

The present invention concerns surface related projectile targets and is specifically directed to an improved target construction supported on a playing field surface and devised to emit a distinctive sound when struck by a game ball traveling on said surface and aimed at the target.

It is an object of the invention to provide a simplified yet rugged game target construction capable of being hand-pressed or impact-driven into the ground forming the field surface and when hit by a moving game ball will give a distinctive audible sound, even at a distance from the target, indicative of the fact that the target had been struck.

Another more specific object of this invention is to provide a target construction that may be economically furnished in sets of four or more pieces to provide a package for playing a croquet-like game by a number of persons.

A further object of the invention is to provide a game surface related projectile target construction that may be approached and struck by a game ball moving at it from all angles and which will emit a distinctive sound whenever it is hit by said ball.

Still further advantageous objects of this invention will be apparent from the following specification taken in conjunction with the accompanying drawings, which disclose a preferred embodiment of the invention, and wherein:

FIG. 1 is an elevational view of my game target shown in operative position on the ground area selected to provide the field surface for a projectile such as a ball.

FIGS. 2 and 3 are sections taken on lines 2—2 and 3—3, respectively, of FIG. 1.

Figure 2:
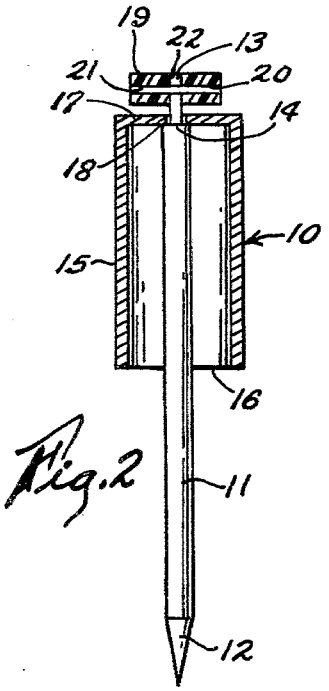
Figure 1:
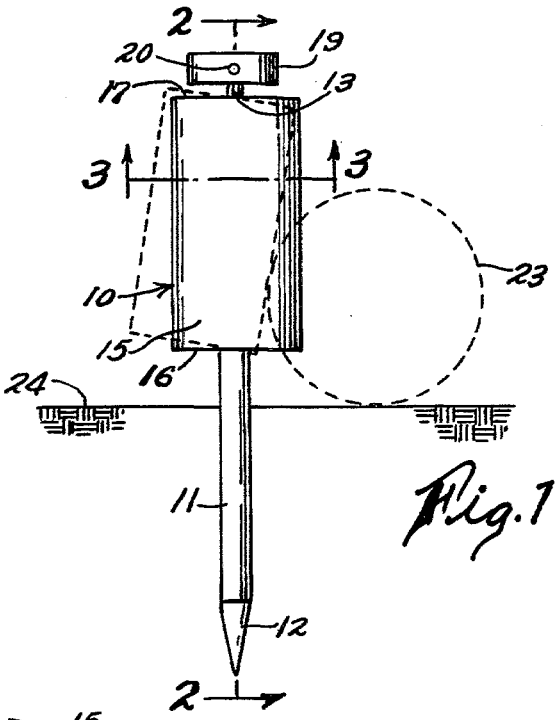
Figure 3:
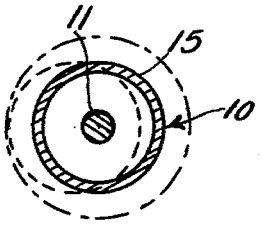

With reference to FIGS. 1, 2 and 3 of the drawings the numeral 10 indicates one form of my game target construction having a metallic stake 11 provided with a pointed lower end 12 and including a reduced upper end 13 which forms an upwardly facing shoulder 14 thereon. A metallic, hollow cylinder 15 surrounds the stake and is mounted upon the stake, concentric therewith; said cylinder having an open bottom end 16 and a top end that is closed by a lateral wall 17. The wall 17 has formed therethrough a central opening 18 that has an internal diameter smaller than the shoulder 14 but large enough to loosely receive the reduced upper end 13 of the stake. A cap 19, preferrably made of plastic material, is mounted on the top portion of the reduced upper end 13 of the stake 11 in vertical spaced relation with the lateral wall 17 of the cylinder, the cap being fixed to the said stake end by a retainer pin 20 forced into aligned holes 21 and 22 formed in the cap and the stake end, respectively.

The cylinder 15 is therefore swivelled upon the upper end of the stake and, as indicated by broken lines in FIGS. 1 and 3, will have universal swinging movement on the stake such that when a game projectile, like a wooden ball 23, traveling upon the field surface, strikes the cylinder from any angle, the open end portion of the cylinder will hit the stake causing the cylinder to vibrate and emit an audible signal. The plastic cap 19 functions as a means of hand pressing the lower pointed end 12 of the stake into relatively soft ground or it can be employed to receive blows from a mallet to drive the stake into harder ground, the stake being positioned in the ground to a depth that disposes the lower open end 16 of the cylinder 15 at a distance from the field surface 24 that is less than the radius of the ball 23.

Figure 5:
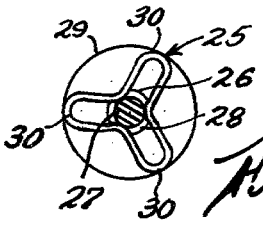
FIG. 5 is a section taken on line 5—5 of FIG. 4.
Figure 4:
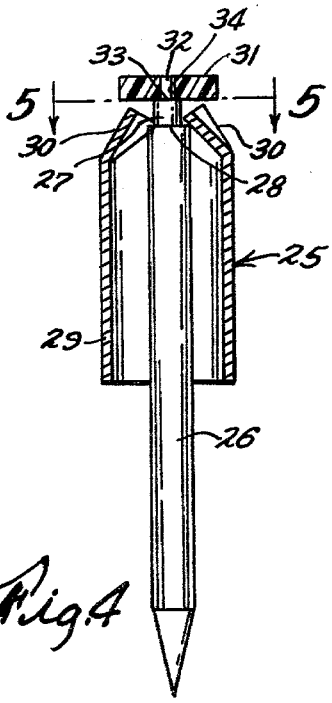
FIG. 4 is a central section showing a modified form of my game target.

FIGS. 4 and 5 of the drawings depict a modified form 25 of the game target of this invention wherein the numeral 26 is a pointed metallic stake having a reduced upper end 27 that provides an upwardly facing shoulder 28 thereon. A metallic hollow cylinder 29 is mounted for swinging motion upon the upper end of the stake by a swivel means which includes a closure consisting of a plurality of inwardly directed flutes 30 formed integral on the upper end of the cylinder by pressing angularly spaced apart portions of the cylinder inwardly on a mandrel; the inner edges of the flutes providing an annular opening to loosely receive the upper reduced end 27 of the stake 26 and having their innermost edge portions resting upon the shoulder 28 of said stake. A plastic cap 31 is fixed on the upper end of the stake in vertical spaced relation with the flutes 30 by the expedient of a further reduced portion 32 on said upper end to form a shoulder 33 thereon; the cap 31 having a central hole 34 formed therethrough which has an interference fit with the said portion 32 that is limited by the shoulder 33.

Figure 6:
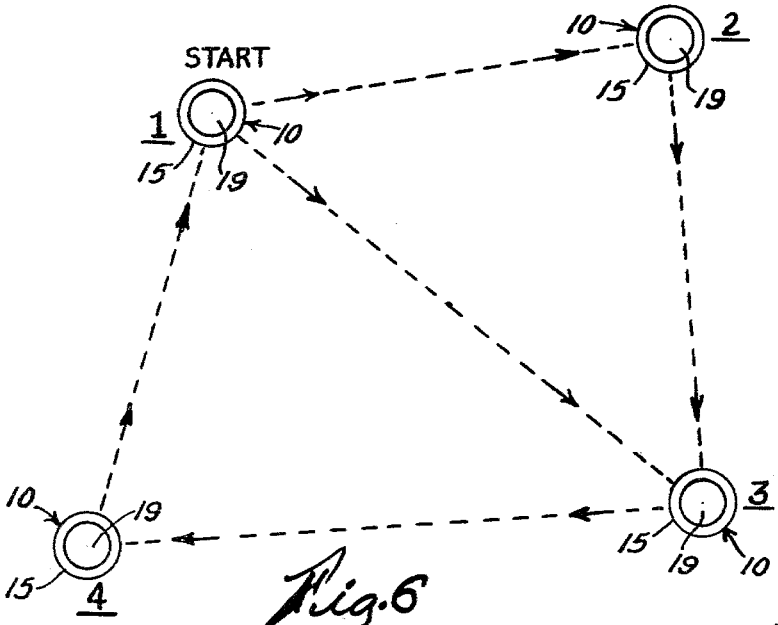
FIG. 6 is a diagramatic plan view of a representative field for playing a game using several targets of this invention.

Now with reference to FIG. 6 of the drawings there is illustrated a representative field for playing a game with targets 10 or 25 of this invention wherein four of the targets are spaced apart in, say, a rectangular pattern. Players, each provided with a croquet-like mallet and a ball, successively start the game at the target area identified as No. 1 and endeavor to drive a ball with the mallet in such a manner as to strike target No. 2 in the least number of strokes. Each player then proceeds from target No. 2 to the next numbered targets until all players have completed the game, the player with the least number of total strokes being considered the winner of the game.

What is claimed is:

1. A field surface related projectile target construction including a ball and the target, the target being designed to be positioned on the field surface and the ball being designed to travel upon the surface, the target consisting of an upstanding metallic stake adapted to be driven through the field surface, an elongated, hollow metallic cylinder surrounding and normally out of contact with the upper portion of the stake, swivel means mounting the upper end of the cylinder to the upper end portion of the stake and adapted to permit the lower end of the cylinder to swing into contact with a middle portion of the stake, said cylinder, when the stake is positioned on the field surface, having its lower end spaced a distance from the said surface that is less than the radius of the ball, whereby when the ball strikes the lower free end of the cylinder from any angle an audible signal will be emitted by the target.

2. In the field surface related projectile target construction set forth in claim 1 wherein the swivel means consists of a reduced end formed on the stake to provide an upwardly facing shoulder thereon, a number of inwardly directed flutes integral on the upper end of the cylinder, the innermost edges of the flutes forming an annular opening on the cylinder to freely receive the reduced upper end of the stake and rest upon the shoulder, and a cap fixed on the terminal upper end of the stake in spaced vertical relation with the flutes.

* * * * *